US010104971B1

(12) United States Patent
Yang

(10) Patent No.: US 10,104,971 B1
(45) Date of Patent: Oct. 23, 2018

(54) CHAIR WITH ADJUSTABLE BACKREST

(71) Applicant: Zhejiang Hengfeng Top Leisure Co., Ltd., Wukang Town (CN)

(72) Inventor: Baoqing Yang, HangZhou (CN)

(73) Assignee: Zhejiang Hengfeng Top Leisure Co., Ltd., Wukang Town (CN)

( * ) Notice: Subject to any disclaimer, the term of this patent is extended or adjusted under 35 U.S.C. 154(b) by 17 days.

(21) Appl. No.: 15/632,469

(22) Filed: Jun. 26, 2017

(51) Int. Cl.

| | |
|---|---|
| ***A47C 4/00*** | (2006.01) |
| ***A47C 7/46*** | (2006.01) |
| ***A47C 1/032*** | (2006.01) |
| ***A47C 4/28*** | (2006.01) |
| *A47D 1/02* | (2006.01) |
| *A47C 5/10* | (2006.01) |
| *A47C 4/04* | (2006.01) |

(52) U.S. Cl.
CPC ..... *A47C 7/462* (2013.01); *A47C 1/03205* (2013.01); *A47C 4/286* (2013.01); *A47C 4/045* (2013.01); *A47C 4/28* (2013.01); *A47C 4/283* (2013.01); *A47C 5/10* (2013.01); *A47D 1/02* (2013.01)

(58) Field of Classification Search
CPC ..... A47C 4/283; A47C 4/045; A47C 4/00; A47C 5/10; A47D 1/02
USPC ..... 297/16.1–60
See application file for complete search history.

(56) References Cited

U.S. PATENT DOCUMENTS

| | | | | |
|---|---|---|---|---|
| 136,099 A | | 2/1873 | Russell | |
| 1,703,879 A | | 3/1929 | Goldwyn | |
| 1,782,763 A | | 11/1930 | Overbey | |
| 2,096,237 A | * | 10/1937 | Elmer | A47C 4/283 297/45 |
| 2,288,411 A | * | 6/1942 | Lowenherz | A47C 4/36 297/19 |
| 2,347,478 A | * | 4/1944 | Heddens | A47C 4/36 297/29 |
| 2,710,645 A | * | 6/1955 | Luckhardt | A47C 1/035 297/29 |
| 2,733,754 A | * | 2/1956 | Leslie et al. | A47D 13/043 297/42 |
| D179,878 S | | 3/1957 | Bernier | |
| 2,879,831 A | | 3/1959 | Williamson | |
| 3,215,469 A | * | 11/1965 | Wamsley | A47C 1/035 108/135 |
| 3,269,767 A | * | 8/1966 | Marzocchi | A47C 4/12 297/29 |
| 3,861,743 A | * | 1/1975 | Danton | A47C 1/024 297/329 |
| 4,082,348 A | * | 4/1978 | Haury | A61G 5/08 297/45 |
| 4,083,598 A | * | 4/1978 | Thomas | A47C 4/00 297/440.15 |
| 5,415,455 A | * | 5/1995 | Geldbaugh | A47C 4/02 297/16.2 |
| 5,560,675 A | | 10/1996 | Altheimer et al. | |
| 5,702,152 A | | 12/1997 | Shaw | |

(Continued)

*Primary Examiner* — Syed A Islam
(74) *Attorney, Agent, or Firm* — Thompson Coburn LLP

(57) ABSTRACT

A folding chair has a frame having first and second front legs and first and second rear legs. A back rest is operatively pivotally connected to the rear legs. A seat is slidingly connected to the first and second front legs and pivotally connected to the back rest, thereby enabling the angle of the backrest relative to the rear leg to be adjustable as the seat slides toward and away from the front legs.

19 Claims, 7 Drawing Sheets

(56) References Cited

U.S. PATENT DOCUMENTS

| | | | | |
|---|---|---|---|---|
| 6,439,656 | B1 | 8/2002 | Liu | |
| 6,926,356 | B2 * | 8/2005 | Chen | A47C 4/286 297/35 |
| 7,100,975 | B1 | 9/2006 | Zheng | |
| 7,641,276 | B1 * | 1/2010 | Chen | A47C 4/286 297/35 |
| 7,758,111 | B2 * | 7/2010 | Chen | A47C 4/286 297/16.1 |
| 7,828,377 | B2 | 11/2010 | Grace | |
| 7,918,495 | B2 * | 4/2011 | Chen | A47C 4/283 297/42 |
| 7,942,476 | B2 * | 5/2011 | Chen | A47C 4/286 297/16.2 |
| 8,454,084 | B2 | 6/2013 | Lah | |
| 8,511,747 | B2 | 8/2013 | Lougee | |
| 8,678,490 | B2 | 3/2014 | Chen | |
| 8,696,052 | B2 | 4/2014 | Zhu | |
| 8,864,222 | B2 * | 10/2014 | Grace | A47C 4/286 297/35 |
| 9,468,297 | B2 * | 10/2016 | Grace | A47C 7/70 |
| 9,655,453 | B2 * | 5/2017 | Starck | A47C 4/283 |
| 2008/0122268 | A1 * | 5/2008 | Kim | A47C 1/146 297/16.2 |
| 2010/0013273 | A1 * | 1/2010 | Chen | A47C 4/283 297/42 |
| 2010/0171342 | A1 * | 7/2010 | Chen | A47C 4/283 297/45 |
| 2011/0169304 | A1 * | 7/2011 | Chen | A47C 4/283 297/35 |
| 2014/0015287 | A1 * | 1/2014 | Zhu | A47C 4/28 297/35 |

* cited by examiner

CHAIR WITH ADJUSTABLE BACKREST

BACKGROUND

The present disclosure relates to a chair having an adjustable backrest. In particular, the disclosure relates to a folding chair having an adjustable backrest.

DETAILED DESCRIPTION

Figure 1:
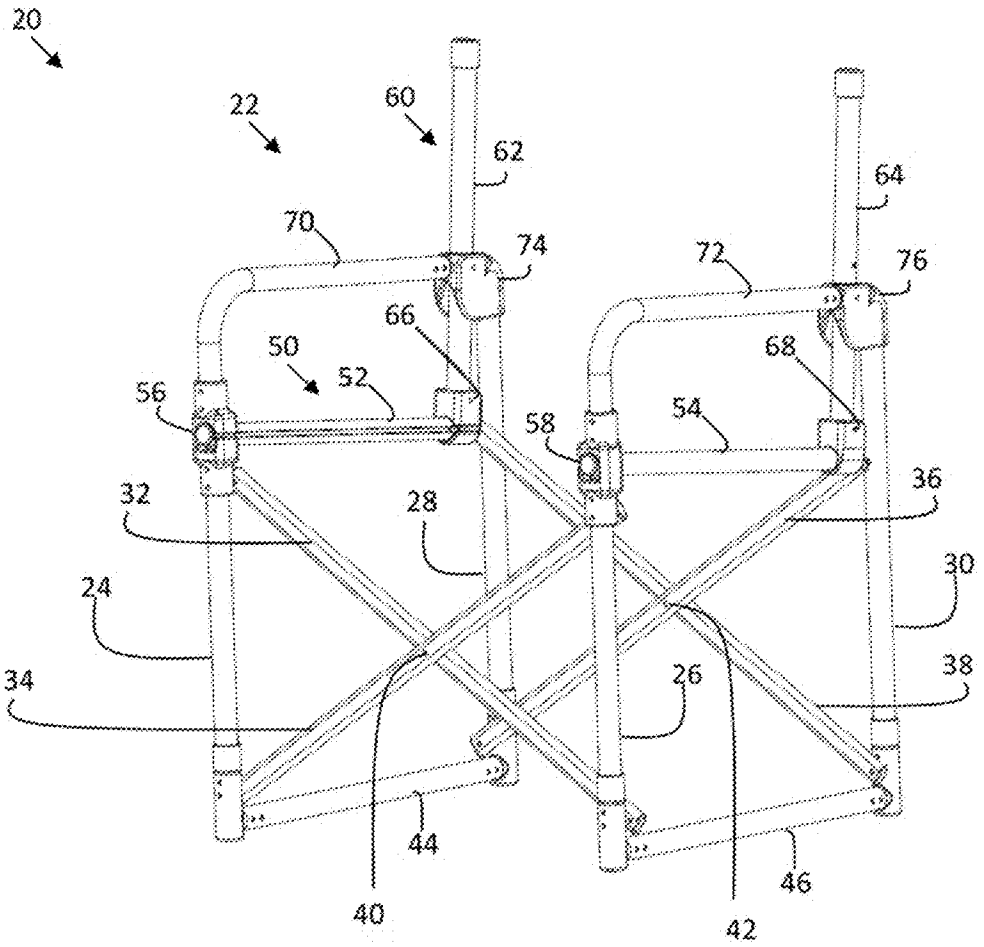
FIG. 1 is a perspective view of an exemplary chair in an unfolded arrangement.

The chair 20 has a frame 22 comprising first and second front legs 24,26, and first and second rear legs 28,30. The frame 22 may also have first and second front crossbeams 32,34, and first and second rear crossbeams 36,38. One end of the first front crossbeam 32 may be pivotally connected to the first front leg 24 and an opposite end of the first front crossbeam may be pivotally connected to the second front leg 26. One end of the second front crossbeam 34 may be pivotally connected to the first front leg 24 and an opposite end of the second front crossbeam may be pivotally connected to the second front leg 26. The first and second rear crossbeams 36,38 may have a similar arrangement with one end of the first rear crossbeam being pivotally connected to the first rear leg 28 and the opposite end of the first rear crossbeam being pivotally connected to the second rear leg 30, and one end of the second rear crossbeam being pivotally connected to the first rear leg and an opposite end of the second rear crossbeam being pivotally connected to the second rear leg. The pivot connections of the crossbeams to each leg may be spaced apart on each leg to allow the cross beams and the legs to pivot relative to each other. The first and second front crossbeams 32,34 may have a pivot connection 40 with each another. The first and second rear crossbeams may have a pivot connection 42 with each another.

The frame 22 of the chair 20 may include first and second bottom supports 44,46. The first bottom support 44 may extend from the first front leg 24 to the first rear leg 28.

The second bottom support 46 may extend between the second front leg 26 and the second rear leg 30. The first and second bottom supports 44,46 may assist in maintaining the structural integrity of the frame 22. The bottom supports 44,46 may maintain the first and second front legs 24,26 in a spaced apart configuration relative to the first and second rear legs 28,30.

The pivoting connections of the front and rear crossbeams with the front and rear legs allow the chair to be moved between a folded arrangement and an unfolded arrangement. In the unfolded arrangement, the first and second front legs 24,26 may be spaced apart from one another with the first and second front crossbeams 32,34 extending therebetween and generally transverse to the legs. The first and second rear legs 28,30 may be spaced apart from one another with the first and second rear crossbeams 36,38 extending therebetween and generally traverse to the legs. In the folded position arrangement, the first front leg 24 may be adjacent to the second front leg 26 with the first and second front crossbeams 32,34 folded therebetween and extending generally parallel to the first and second front legs. The first rear leg 28 may be adjacent to the second rear leg 30 with the first and second rear crossbeams 36,38 folded therebetween and extending generally parallel to the first and second rear legs. In both the unfolded and folded arrangements, the front legs 24,26 are spaced from the rear legs 28,30, for instance, by the first and second bottom supports 44,46.

Figure 2:
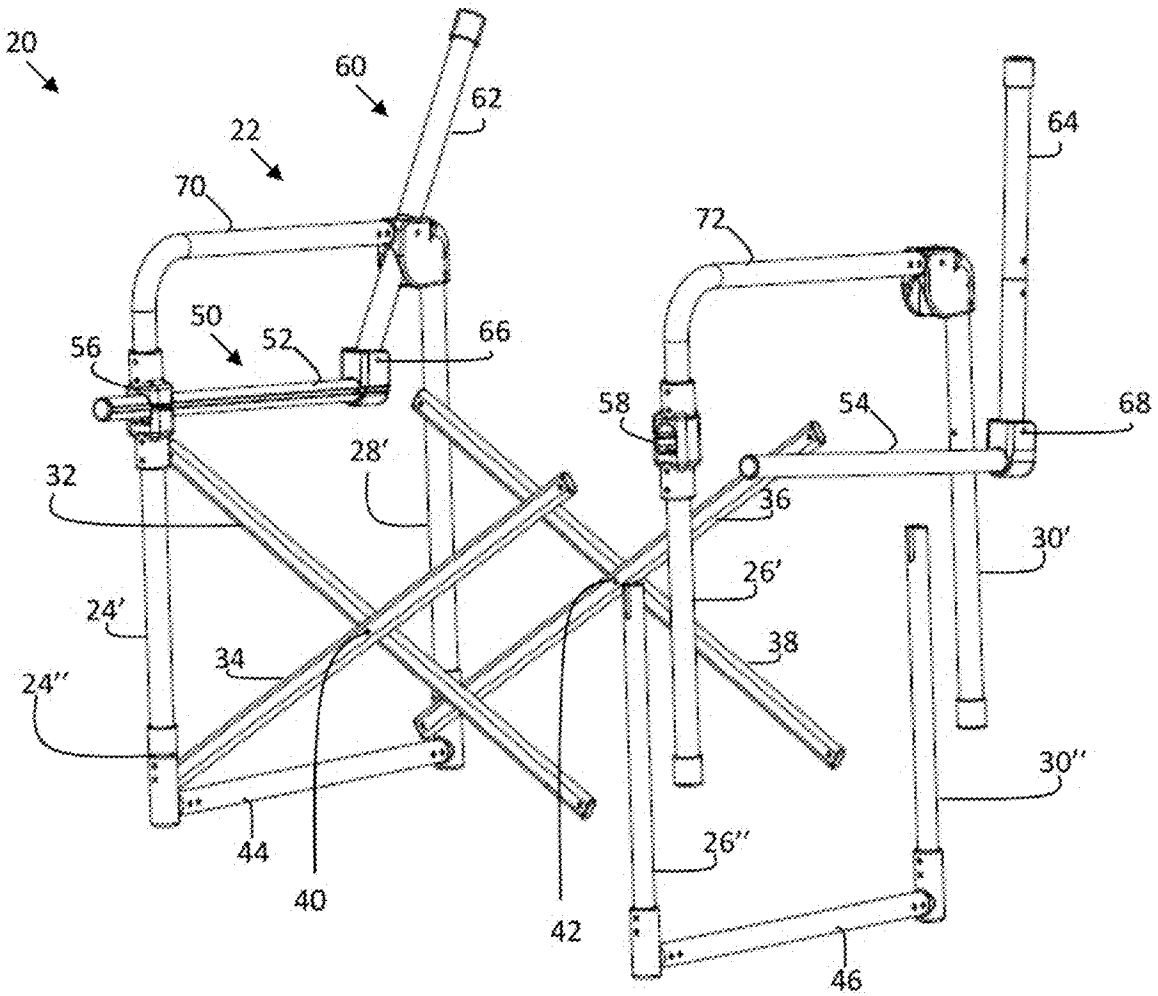
FIG. 2 is an exploded perspective view of the chair of FIG. 1.

To facilitate moving the chair between the folded arrangement and the unfolding arrangement, each of the legs may comprise telescoping members. As best shown in FIG. 2, each leg 24,26,28,30 comprises an outer tubular member 24',26',28',30' and an inner tubular member 24",26",28",30". The inner tubular member 24",26",28",30" may extend from the respective bottom support 44,46 with the outer tubular member 24',26',28',30' disposed therearound in a telescoping arrangement. The arrangement of the inner and outer tubular member may also be reversed.

The chair 20 further comprises a seat 50. The seat 50 may have first and second seat support beams 52,54. The first seat and second seat support beams 52,54 may be generally orthogonal to the legs. The first seat support beam 52 may have a sliding connection 56 with the first front leg 24. The second support beam 54 may have a sliding connection 58 with the second front leg 26. One or both of the sliding connections 56,58 in the first and second front legs 24,26 may be a channel adapted and configured to receive the first and second support seat support beams 52,54, respectively. One or both of the sliding connections 56,58 may comprise a bushing mounted to an end of the first and second front legs. One or both of the sliding connections 56,58 may also comprise a slot or a notch formed in the first and second front legs. One or both of the sliding connections 56,58 may also comprise an attachment extending or projecting from the first and second front legs. In addition, the sliding connection 56,58 may comprise a rack and roller provided on the seat support beams and the first and second front legs. The first and second seat support beams 52,54 may directly bear against an interior of the channel of the sliding connection 56,58 to allow sliding motion between the first and second front legs and the first and second seat support beams. Rollers may also be provided in the sliding connection. The rollers may be provided on the seat support beam or in the bushing or channel of the first and second front legs. While a relatively short axial length channel on the first and second front legs is shown in the drawings, the axial length of the sliding connection of the first and second front legs with the seat support beams may be extended to accommodate the full length of travel of the seat support beams. Additionally, the distal end of the seat support beams may be provided with a stop to prevent the seat support beam from being disconnected from the channel. As shown in the drawings, the sliding connection 56,58 allows movement of the seat support beams in either direction toward or away from the front legs 24,26. The sliding connection 56,58 may also be configured to limit or restrict motion selectively. For instance, the sliding connection 56,58 may have a clamp or locking mechanism to fix the position of the seat support beams 52,54 in the sliding connection.

Figure 10:
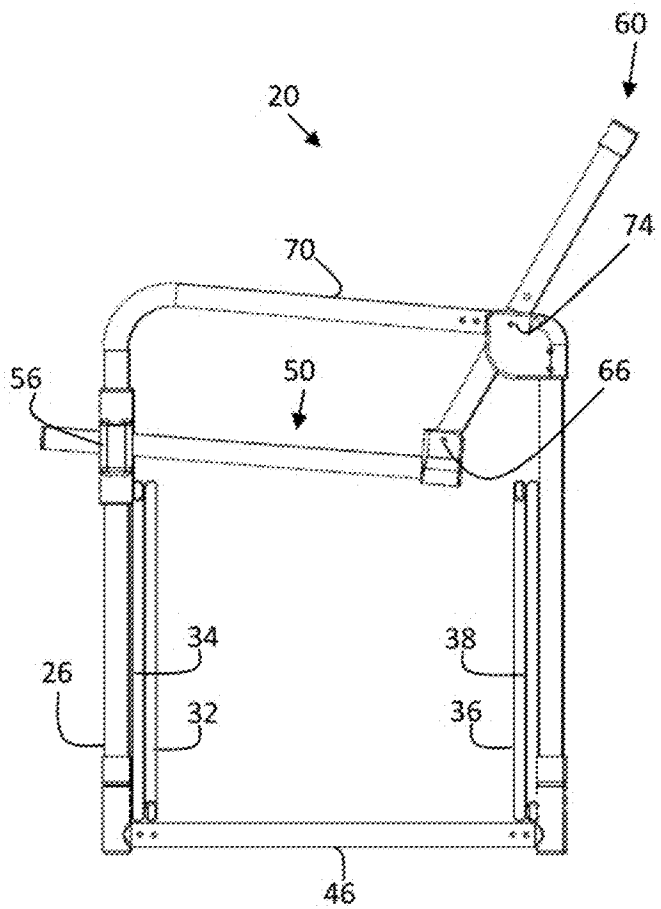
FIG. 10 is a right side view of the chair of FIG. 1 with the backrest in a second position.
Figure 9:
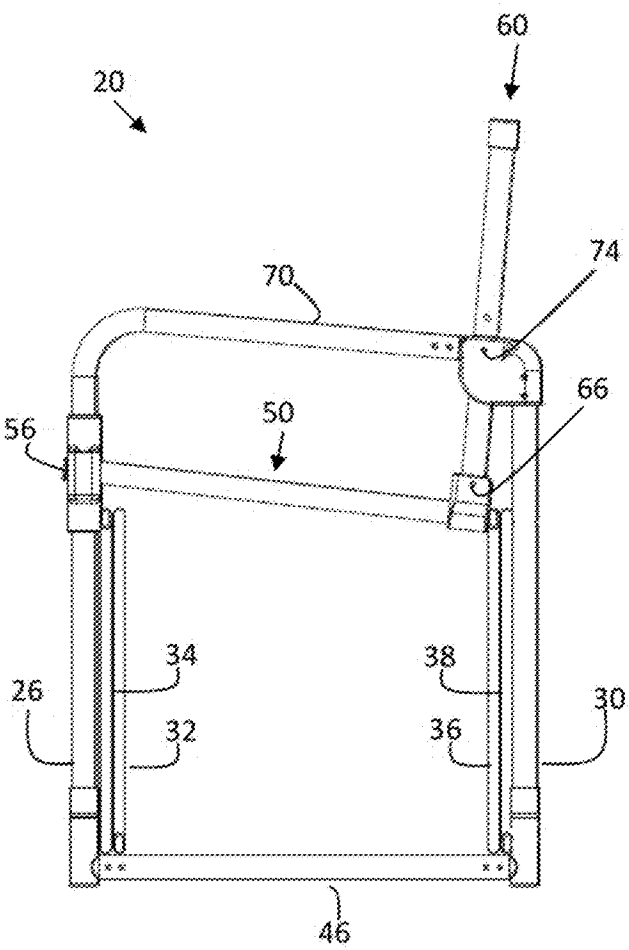
FIG. 9 is a right side view of the chair of FIG. 1 with a backrest in a first position.
Figure 12:
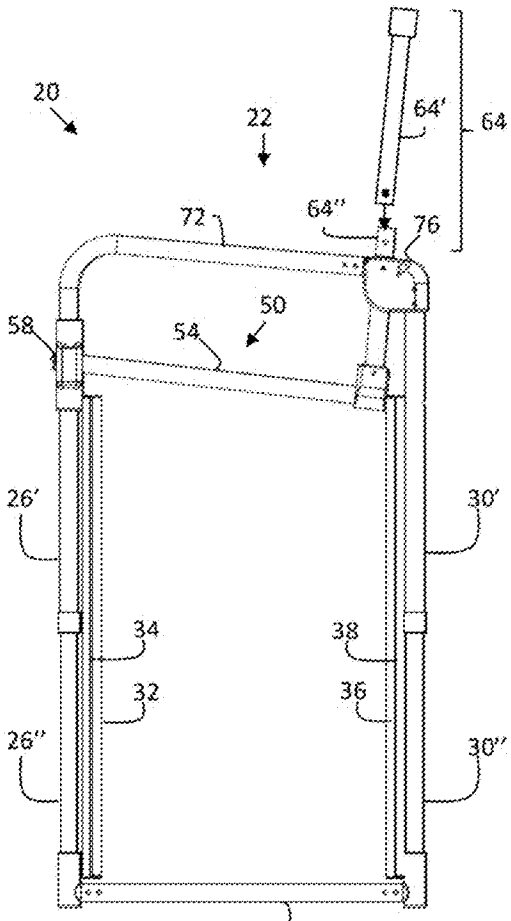
FIG. 12 is a right side view of the chair of FIG. 1 in a folded arrangement.
Figure 11:
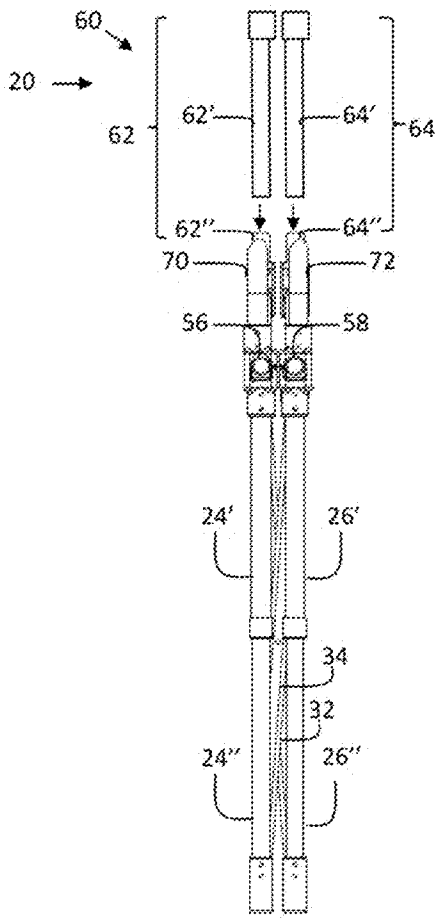
FIG. 11 is a front view of the chair of FIG. 1 in a folded arrangement.

The chair 20 further has a backrest 60 that is pivotally connected to the seat and the frame 22 of the chair. As shown in the drawings, the backrest 60 comprises first and second backrest beams 62,64. The first backrest beam 62 may have a pivot connection 66 with the first seat support beam 52 and the second backrest beam 64 may have a pivot connection 68 with the second seat support beam 54. The first backrest beam 62 may be operatively pivotally connected to the first rear leg 28 and the second backrest 64 beam may be operatively pivotally connected to the second rear leg 30. The pivot connections of the backrest to the seat and the frame, together with the sliding connection of the seat to the frame allow the backrest to be adjustable and, for example, move between the positions shown in FIGS. 9 and 10. The seat is solely supported by the pivot connection with the backrest and the sliding connection with the front legs. Thus, an angle of the backrest relative to the rear leg may be adjusted as the seat slides toward and away from the front legs. As shown in FIGS. 11 and 12, the back rest beams 62,64 may comprise two parts releasably connected together, for instance, through a depressable button on one part that springingly engages a hole formed on the other part. The parts of each back rest beam may connected with an elastic cord to prevent their separation once detached. In this way, the back rest beams 62,64 may be detached to reduce the overall size of the chair for shipping and storage.

The chair 20 may also comprise a first armrest 70 operatively connected to the first rear leg 28, and a second armrest 72 operatively connected to the second rear leg 30. Couplings 74,76 may be provided to connect the first and second armrests 70,72 to the first and second rear legs 28,30, respectively. The backrest 60 may be pivotally connected to the respective couplings 74,76. For instance, the first and second backrest beams 62,64 may be pivotally connected to their respective couplings 74,76. The first and second armrests 70,72 may also, or in the alternative, be connected to the first and second front legs 24,26 respectively.

Figure 3:
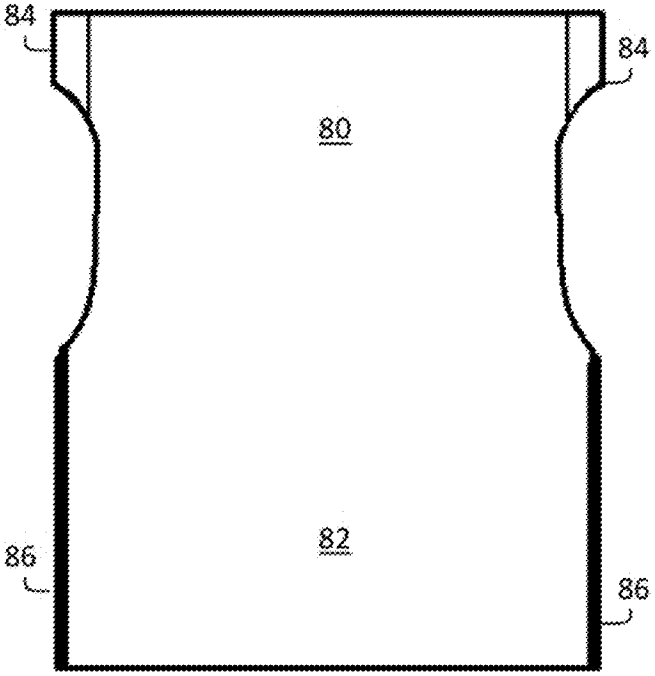
FIG. 3 is a plan view of an exemplary seat and back rest panel used with the chair of FIG. 1.
Figure 4:
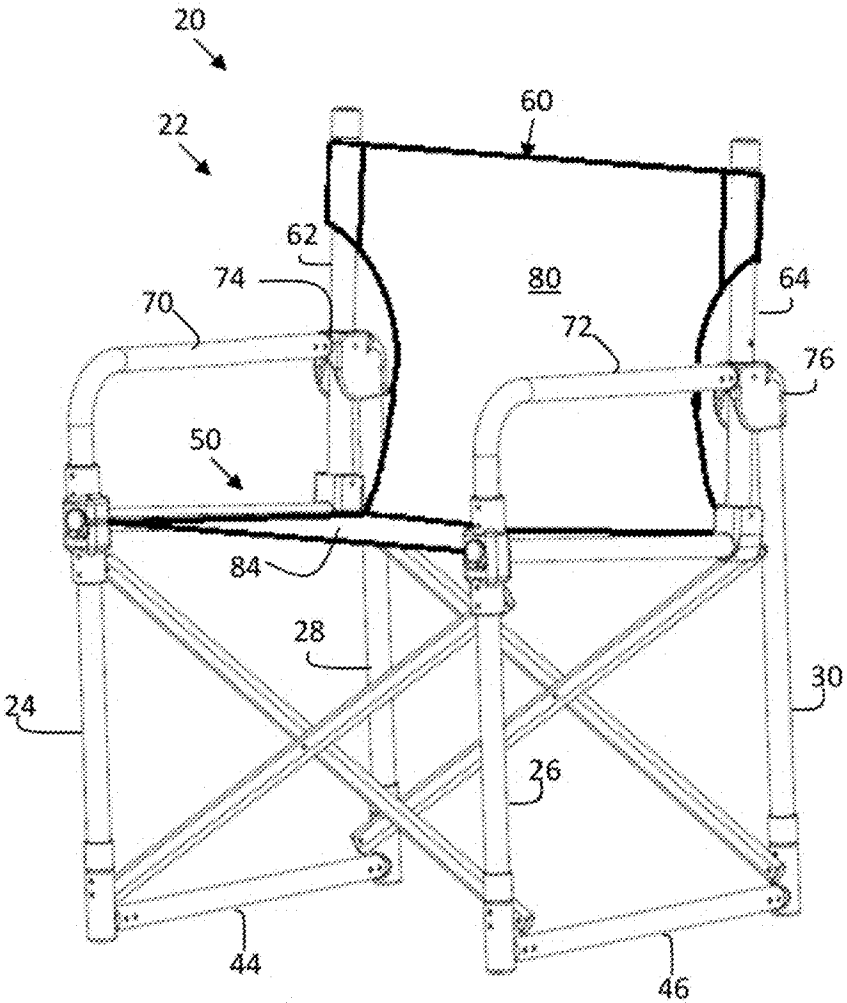
FIG. 4 is a perspective view of the chair of FIG. 1 with the back rest panel of FIG. 3 and the seat panel of FIG. 4 installed.
Figure 6:
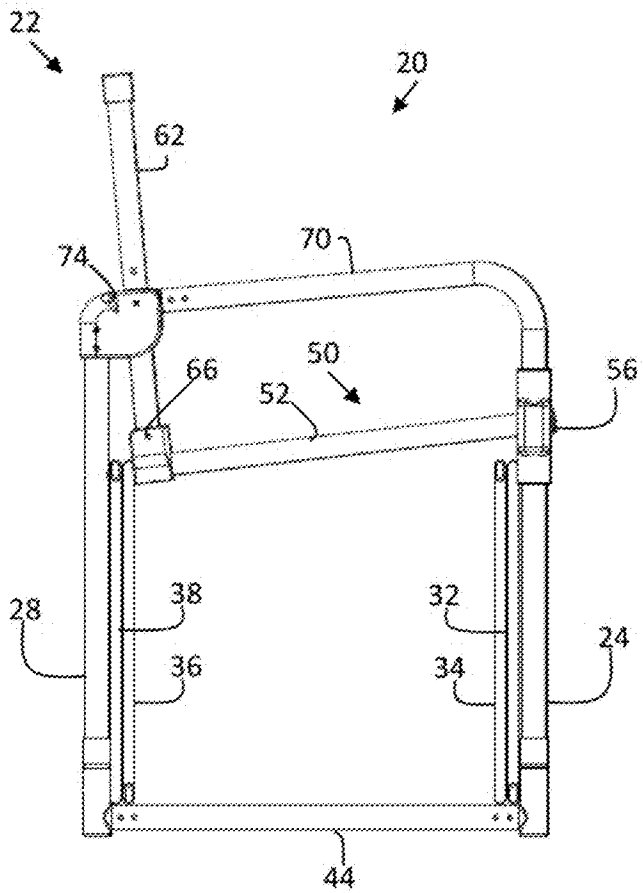
FIG. 6 is a left side view of the chair of FIG. 1.
Figure 5:
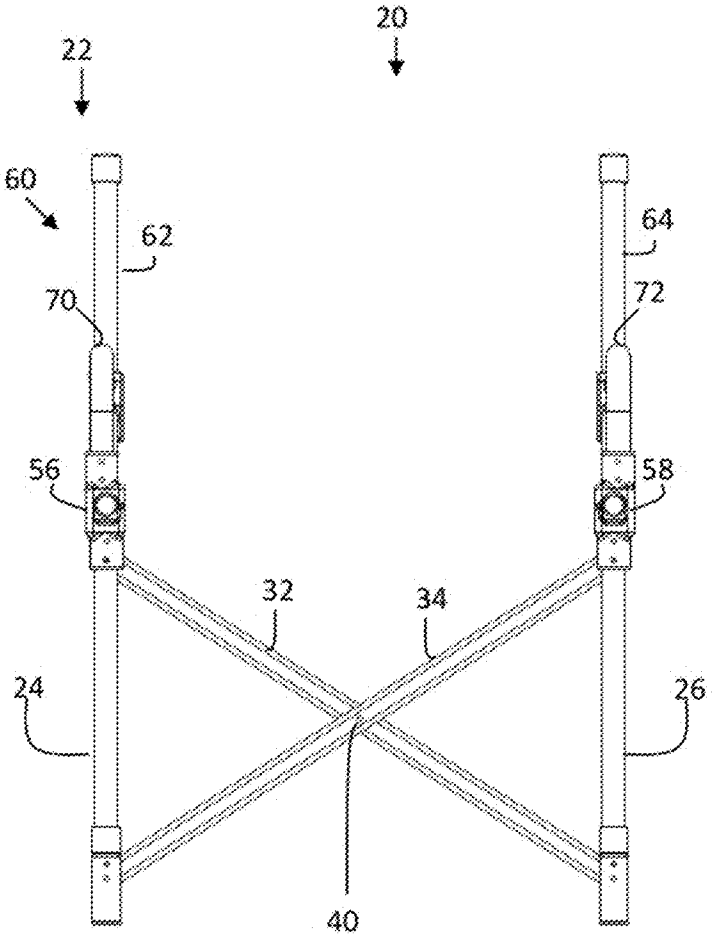
FIG. 5 is a front view of the chair of FIG. 1.
Figure 8:
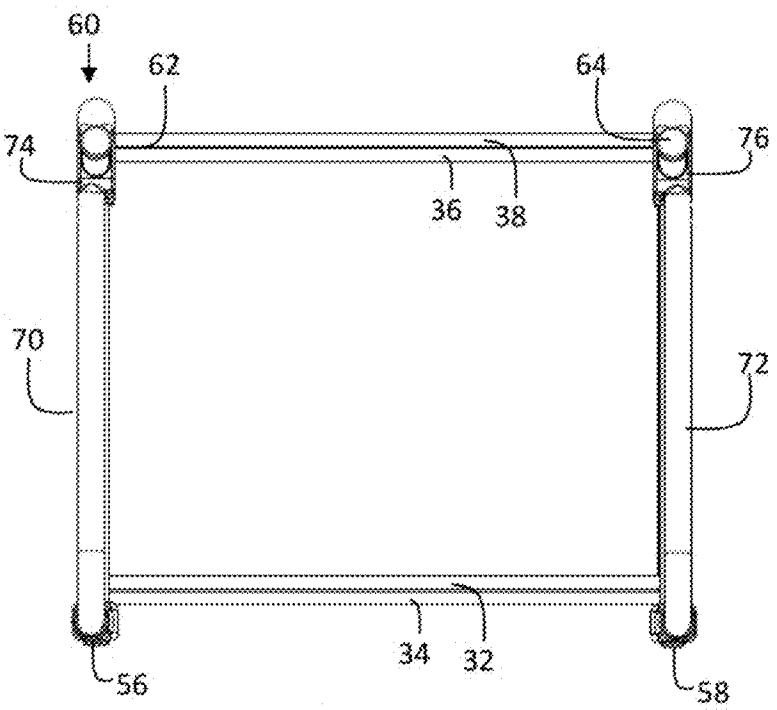
FIG. 8 is a top view of the chair of FIG. 1.
Figure 7:
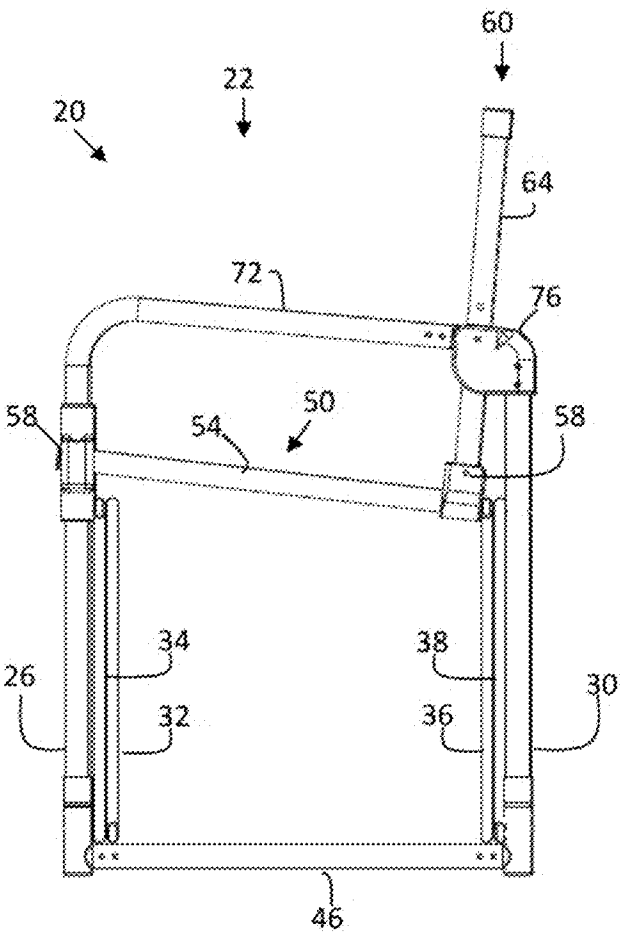
FIG. 7 is a right side view of the chair of FIG. 1.

Referring to FIGS. 3 and 4, the chair 20 may be provided with a panel having a back rest section 80 and a seat section 82 forming the backrest and seat. The panel may be one piece as shown or separate pieces. The panel may comprise pliable materials, for instance, woven or non-woven fabric, or polyester, canvas, etc. The panel sections 80,82 may have sleeves formed on their outer margins that receive the respective beams. The sleeves may be formed by folding over the margins of the panel sections and stitching them back to the respective panel sections, or through use of a releasable material, for instance a hook and loop material. The panel sections may also be attached to the frame of the chair by lacing or by forming a bead on the margins of the panel and inserting the bead into groves formed in the first and second seat support beams and the first and second backrest beams, or a combination thereof. For instance, as shown in FIG. 3, the backrest panel section 80 has sleeves 84 formed on its left and right margins which receive the first and second backrest beams 62,64, and the seat panel 82 may has smaller sleeves 86 on its left and right outer margins that receive a bead that cooperates with grooves on the first and second seat support beams 52,54.

Further embodiments can be envisioned to one of ordinary skill in the art after reading this disclosure. In other embodiments, combinations or sub-combinations of the above-disclosed invention can be advantageously made. The example arrangements of components are shown for purposes of illustration and it should be understood that combinations, additions, re-arrangements, and the like are contemplated in alternative embodiments of the present invention. Thus, various modifications and changes may be made thereunto without departing from the broader spirit and scope of the invention as set forth in the claims and that the invention is intended to cover all modifications and equivalents within the scope of the following claims.

What is claimed is:

1. A folding chair comprising:

first and second front legs with first and second front cross beams extending therebetween, an end of the first front cross beam being pivotally connected to the first front leg and an opposite end of the first front cross beam being pivotally connected to the second front leg, an end of the second front cross beam being pivotally connected to the first front leg and an opposite end of the second front cross beam being pivotally connected to the second front leg;

first and second rear legs with first and second rear cross beams extending therebetween, an end of the first rear cross beam being pivotally connected to the first rear leg and an opposite end of the first rear cross beam being pivotally connected to the second rear leg, an end of the second rear cross beam being pivotally connected to the first rear leg and an opposite end of the second rear cross beam being pivotally connected to the second rear leg;

first and second seat support beams, the first seat support beam being slidably connected to the first front leg, the second seat support beam being slidably connected to the second front leg;

first and second back rest beams, the first back rest beam being pivotally connected to the first seat support beam, the second back rest beam being pivotally connect to the second seat support beam, the first back rest beam being operatively pivotally connected to the first rear leg, the second back rest beam being operatively pivotally connected to the second rear leg.

2. The chair of claim 1 further comprising a first arm rest operatively connected to the first rear leg, and a second arm rest operatively connected to the second rear leg.

3. The chair of claim 2 further comprising couplings connecting the first and second arm rests to the respective first and second rear legs.

4. The chair of claim 3 wherein the first and second back rest beams are pivotally connected to the respective couplings.

5. The chair of claim 2 wherein the first arm rest is operatively connected to the first front leg and the second arm rest is operatively connected to the second front leg.

6. The chair of claim 1 wherein the first and second front cross beams are pivotally connected.

7. The chair of claim 1 wherein the first and second rear cross beams are pivotally connected.

8. The chair of claim 1 wherein each of the legs has first and second leg members telescopically connected together.

9. The chair of claim 1 wherein each of the front legs comprises a channel adapted and configured to receive the first and second seat support beams, respectively.

10. The chair of claim 1 wherein the chair is movable between a folded arrangement and an unfolded arrangement, wherein in the folded arrangement, the first and second front legs are adjacent to one another with the first and second front cross beams therebetween, the first and second rear legs are adjacent to one another with the first and second rear cross beams therebetween, and the front legs are spaced apart from the rear legs; and wherein the unfolded arrangement, the first and second front legs are spaced from one another with the first and second front cross beams extending therebetween, the first and second rear legs are spaced from one another with the first and second front cross beams extending therebetween, and the front legs are spaced apart from the rear legs.

11. A folding chair comprising: a frame having first and second front legs and first and second rear legs; a back rest operatively pivotally connected to the rear legs; and a seat slidingly connected to the first and second front legs and pivotally connected to the back rest, thereby enabling an angle of the backrest relative to the rear leg to be adjustable as the seat slides toward and away from the front legs, wherein the first and second front legs have first and second front cross beams extending therebetween with an end of the first front cross beam being pivotally connected to the first front leg and an opposite end of the first front cross beam being pivotally connected to the second front leg, an end of the second front cross beam being pivotally connected to the first front leg and an opposite end of the second front cross beam being pivotally connected to the second front leg.

12. A folding chair comprising: a frame having first and second front legs and first and second rear legs; a back rest operatively pivotally connected to the rear legs; and a seat slidingly connected to the first and second front legs and pivotally connected to the back rest, thereby enabling an angle of the backrest relative to the rear leg to be adjustable as the seat slides toward and away from the front legs, wherein the first and second rear legs have first and second rear cross beams extending therebetween with an end of the first rear cross beam being pivotally connected to the first rear leg and an opposite end of the first rear cross beam being pivotally connected to the second rear leg, an end of the second rear cross beam being pivotally connected to the first rear leg and an opposite end of the second rear cross beam being pivotally connected to the second rear leg.

13. The chair of claim 11 wherein the seat has first and second seat support beams slidably connected to the first front leg and the second front leg, respectively.

14. The chair of claim 11 where the back rest has first and second back rest beams pivotally connected to the seat and operatively pivotally connected to the first and second rear legs, respectively.

15. The chair of claim 11 wherein each of the legs comprises first and second telescopic members.

16. The chair of claim 11 wherein each of the front legs comprises a channel adapted and configured to receive a portion of the seat.

17. The chair of claim 11 further comprising a first arm rest operatively connected to the first rear leg, and a second arm rest operatively connected to the second rear leg.

18. The chair of claim 17 further comprising couplings connecting the first and second arm rests to the respective first and second rear legs.

19. The chair of claim 18 wherein the back rest is pivotally connected to the respective couplings.

* * * * *